United States Patent [19]

Muggli et al.

[11] Patent Number: 4,524,281

[45] Date of Patent: Jun. 18, 1985

[54] OPTICAL SMOKE DETECTOR WITH SENSITIVITY ADJUSTMENT

[75] Inventors: Jürg Muggli, Männedorf, Switzerland; Peter Gruber, Stäfa, both of

[73] Assignee: Cerberus AG, Birmensdorf, Switzerland

[21] Appl. No.: 439,060

[22] Filed: Nov. 3, 1982

[30] Foreign Application Priority Data

Nov. 11, 1981 [CH] Switzerland ..... 7250/81

[51] Int. Cl.[3] ..... G08B 17/10

[52] U.S. Cl. ..... 250/574; 340/630; 356/338

[58] Field of Search ..... 250/573, 574, 575; 340/630; 356/338, 343, 438, 439

[56] References Cited

U.S. PATENT DOCUMENTS

| | | | |
|---|---|---|---|
| 3,985,453 | 10/1976 | Nakano et al. | 250/574 X |
| 3,992,102 | 11/1976 | Kajii | 250/574 X |
| 4,011,458 | 3/1977 | Malinowski | 250/574 X |
| 4,181,439 | 1/1980 | Tresch et al. | 250/574 X |
| 4,216,377 | 8/1980 | Hasegawa et al. | 356/338 X |
| 4,269,510 | 5/1981 | Horvath et al. | 250/574 X |
| 4,430,646 | 2/1984 | Enemark | 250/574 X |

FOREIGN PATENT DOCUMENTS

| | | |
|---|---|---|
| 8001326 | 6/1980 | European Pat. Off. . |
| 966867 | 8/1964 | United Kingdom . |
| 1172354 | 11/1979 | United Kingdom . |

*Primary Examiner*—Edward P. Westin

*Attorney, Agent, or Firm*—Werner W. Kleeman

[57] ABSTRACT

A smoke detector is disclosed containing a radiation source and a radiation receiver arranged externally of a direct radiation region of the radiation source. In the presence of smoke or other combustion particles in the radiation region the radiation receiver is impinged by scattered radiation. The smoke detector contains optical elements which can be altered by external mechanical actuation, by means of which it is possible to alter in a predetermined manner an output signal of the radiation receiver. In this regard it is possible to either mechanically alter the solid angle which is so-to-speak viewed by the radiation receiver or the solid angle irradiated by the radiation source. The constriction of the active solid angle is preferably accomplished by a diaphragm or membrane displaceable along the radiation direction. Displacement of the diagram is preferably achieved in that, this diaphragm engages by means of dogs or detents in a cam groove, such as a helical-shaped groove of a cam disk, and by rotating the cam disk there can be achieved a defined displacement of the diaphragm.

11 Claims, 7 Drawing Figures

FIG.4
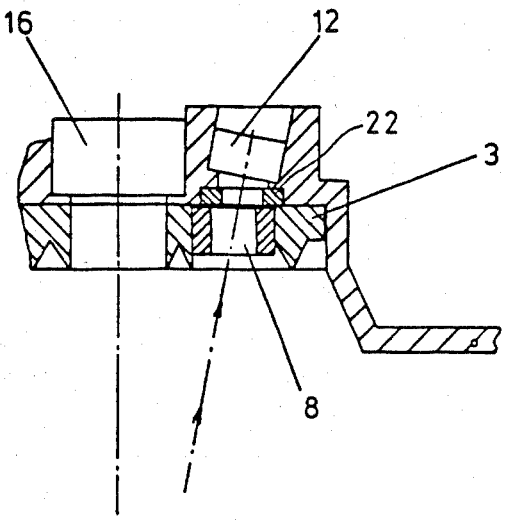
FIG.5A
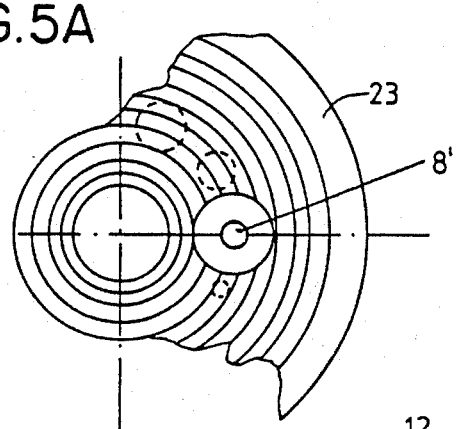
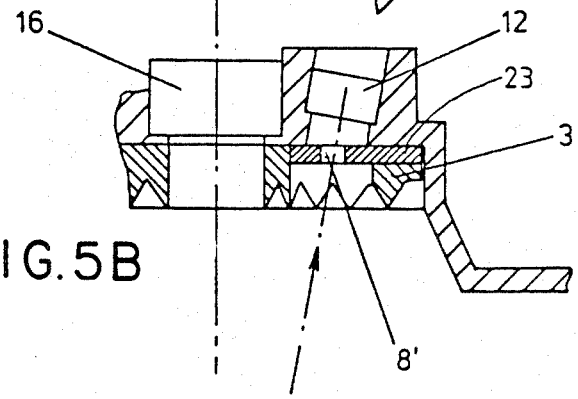
FIG.5B

OPTICAL SMOKE DETECTOR WITH SENSITIVITY ADJUSTMENT

CROSS-REFERENCE TO RELATED APPLICATION

This application is related to the commonly assigned copending U.S. application Ser. No. 439,059, filed Nov. 3, 1982, and entitled "Smoke Detector".

BACKGROUND OF THE INVENTION

The present invention relates to a new and improved construction of a smoke detector which is of the type containing a radiation source which transmits radiation in a predetermined spatial region, and further contains at least one radiation receiver arranged externally of a direct radiation region of the radiation source. There is inputted to the radiation receiver the radiation which is scattered at particles emanating from a combustion process and located in the radiation region.

A smoke detector of this general type is known to the art, for instance from Swiss Pat. No. 592,932. This smoke detector contains an evaluation circuit which triggers an alarm upon attaining a predetermined signal peak of the received scattered radiation. There prevails a fixedly set or adjusted smoke concentration at which there is triggered the alarm.

In order to be able to accommodate the smoke detector to different ambient conditions it is necessary to undertake a sensitivity setting or adjustment. This can be achieved, for instance, by changing an alarm threshold. However, it is frequently advantageous to be able to separately adjust the individual fire alarms or smoke detectors. In the case of ionization smoke detectors, Swiss Pat. No. 468,683 proposes an electrical circuit arrangement for accomplishing sensitivity changes, wherein the adjustment of the response threshold of a field-effect transistor serving as an amplifier and threshold detector is accomplished by means of a potentiometer constituting part of a voltage divider, by means of which there can be biased the source-electrode. Even if the adjustment or setting is not continuously undertaken by means of a potentiometer, rather by means of a switch with which there can be connected into the current circuit fixed resistances of different magnitudes, such electrical adjustment or setting possibilities are prone to disturbance and not resistant to corrosion.

SUMMARY OF THE INVENTION

Therefore, with the foregoing in mind it is a primary object of the present invention to provide a new and improved construction of a smoke detector which is not afflicted with the aforementioned drawbacks and limitations of the prior art.

Another and more specific object of the present invention is directed to a new and improved construction of a smoke detector which does not exhibit the aforementioned drawbacks of the state-of-the-art smoke detectors or fire alarms and, in particular, relates to devising an optical smoke detector, the sensitivity of which can be altered by purely mechanically changing optical components or elements.

Yet a further significant object of the present invention is directed to a new and improved construction of a smoke detector which is relatively simple in construction and design, quite economical to manufacture, not readily subject to breakdown or malfunction, requires a minimum of maintenance and servicing, and the sensitivity of which can be easily and positively changed.

Now in order to implement these and still further objects of the invention, which will become more readily apparent as the description proceeds, the smoke detector of the present development is manifested by the features that, there are provided externally mechanically changeable optical elements which serve to change in a predetermined manner the output signal of the radiation receiver.

According to a preferred construction of the inventive smoke detector, the radiation source transmits light or radiation in a substantially hollow cone-shaped configuration. The radiation receiver is arranged externally of the direct radiation region along the cone axis. The optical elements or means which can be externally mechanically actuated comprise an outer diaphragm provided for the radiation receiver which can be shifted along the cone axis in the direction of the radiation source constituting a radiation transmitter. In this way there is reduced the volume of scattered radiation which is so-to-speak looked at or viewed by the radiation receiver, with the result that there is required a greater density of smoke or other combustion particles or the like in order to generate a predetermined signal at the radiation receiver.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 4 shows a sectional view of part of a further exemplary embodiment of the inventive smoke detector comprising an insert for altering the amount of radiation received by a reference cell;

FIGS. 5A and 5B respectively show a top plan view and a sectional view of part of a further exemplary embodiment of the inventive smoke detector comprising a rotatable ring member with holes of different sizes for altering the amount of radiation received by the reference cell.

DETAILED DESCRIPTION OF THE PREFERRED EMBODIMENTS

Figure 1:
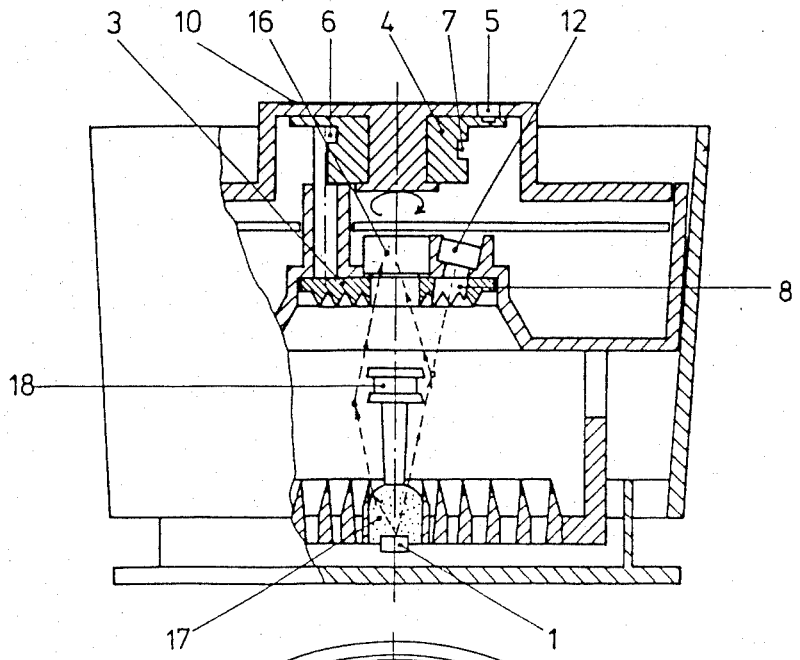
FIG. 1 schematically illustrates, partially in longitudinal sectional view, the construction of an exemplary embodiment of smoke detector according to the invention.

Describing now the drawings, it is to be understood that only enough of the construction of smoke detector designed according to the invention has been illustrated as needed for those skilled in the art to readily understand the underlying principles and concepts of the present development, while simplifying the illustration of the drawings. Turning attention now to FIG. 1, there is shown an exemplary embodiment of smoke detector containing a radiation source 1, for example a suitable semiconductor element which transmits an appropriate type of radiation, for instance, infrared radiation, the radiation source 1 being located at the lower portion of the smoke detector or fire alarm. This infrared radiation is focused into a substantially hollow cone-shaped configuration by means of a suitable optical system 17. A central diaphragm 18 or equivalent structure retains the direct radiation away from a radiation receiver 16. A reference cell 12 measures and regulates the radiation transmitted by the radiation source 1 in a manner for instance disclosed in the aforementioned, commonly assigned, copending United States application. Optical means, here constituted by a diaphragm or membrane 3 or the like limits the radiation or light which is scattered by smoke or other particles emanating from a combustion process to the radiation receiver 16. This diaphragm 3 engages by means of suitable adjustment or setting means, here including cam followers in the form of detents or cams 6 into a cam groove 7, for instance a helical-shaped groove, provided at a cam disk 4 or equivalent structure. By appropriately rotating the cam disk 4 it is possible to intentionally and selectively shift the diaphragm 3 due to the engagement of the cam followers, here the cam detents or dogs 6 into the cam groove 7, up-and-down in the direction of the lengthwise axis of the diaphragm 3. Depending upon the position of the cam disk 4, and thus, the position of the diaphragm 3 whose motion is automatically controlled by the actuation of the cam disk 4, the amount of radiation scattered by the smoke or the like onto the radiation receiver 16 becomes smaller or greater. It has been found that a downward displacement of the diaphragm 3 by several millimeters is sufficient in order to make the smoke detector less sensitive by a factor of two.

What is here important is that the optical means in the form of the diaphragm 3 or the like, during its displacement motion, not disturb the beam of radiation which is directed from the radiation source 1 to the reference cell 12. It is for this reason that an opening or hole 8 is provided in the diaphragm 3, this opening 8 being dimensioned such that, with each position of the diaphragm 3 there can be accomplished an unhindered throughpassage of the radiation. However, this opening 3 also can be used for the mechanical sensitivity-change of the smoke detector, as will be described more fully hereinafter.

By virtue of the described design of the inventive smoke detector there is mechanically altered the solid angle which is viewed by the radiation receiver 16. However, it is readily possible to apply in lieu of the diaphragm 3 a diaphragm which mechanically alters the solid angle irradiated by the radiation source 1, for instance by arranging such diaphragm below the central diaphragm 18 at the region of the radiation source 1.

Figure 2:
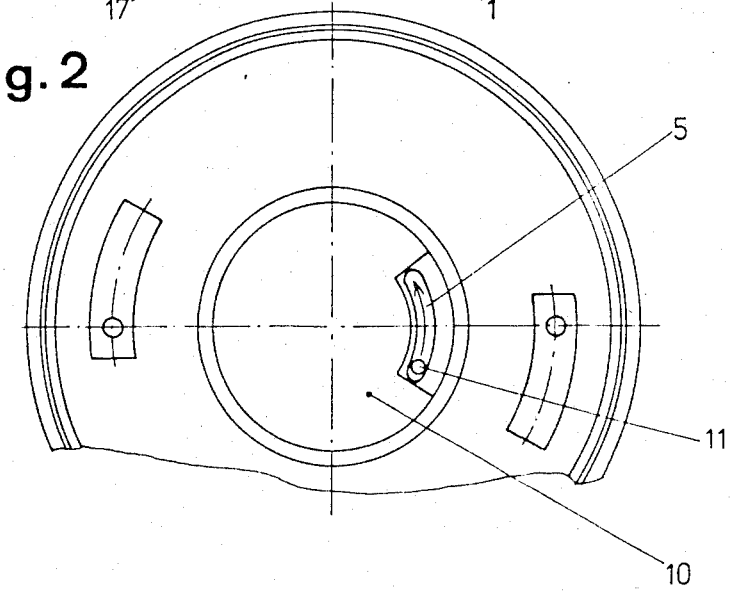
FIG. 2 is a fragmentary top plan view of the arrangement of FIG. 1 showing details of the adjustment mechanism or device for altering the response sensitivity of the smoke detector.
Figure 3:
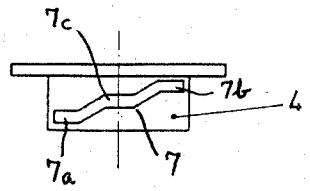
FIG. 3 is a detail showing of part of the arrangement of FIG. 1.
Figure 6:
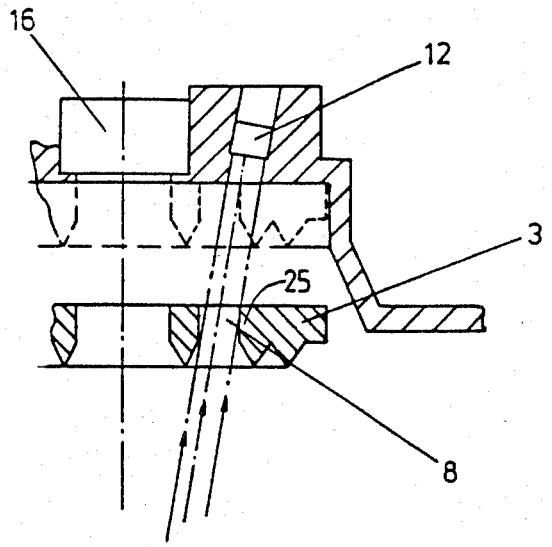
FIG. 6 shows a sectional view of part of a further exemplary embodiment of the inventive smoke detector comprising a modified adjustment mechanism or device for altering the amount of radiation received by the reference cell.

In FIG. 2 there has been shown in top plan view a possible design for actuating the cam disk 4. By means of an elongate slot or hole 5 in a cover member 10 of the smoke detector it is possible to appropriately rotate the cam disk 4. Consequently, with the aid of a suitable tool, such as an actuator pin inserted into a small recess 11 the latter can be shifted from one stop of the elongate slot or hole 5 to the other stop or impact surface thereof. In order to be able to more exactly define the elevational position or height of the diaphragm 3 in both end or terminal positions, the groove 7 of the cam disk 4, instead of possessing a uniformly ascending configuration at both end stops, can possess a respective horizontal portion *7a* and *7b* thereat as shown in FIG. 3. According to a preferred construction of the cam disk 4, the groove 7 is provided, apart from the ends or end portions *7a* and *7b*, also at the intermediate portion *7c* with at least one horizontal partial section or portion. In this case there is also present more than one small recess 11. The spacing of the recesses 11 and the length of the elongate slot or hole 5, in this case, are coordinated to one another such that the displacement of a recess 11 from one end of the slot or hole 5 to the other end thereof allows the detents 6 just to slide up to the next horizontal partial section, and the next recess 11 then just appears at the other end of the hole 5. If the second recess 11 is shifted to the other end of the hole 5, then the detents or dogs 11 slide exactly up to the next horizontal partial section and so forth.

A further design of the inventive mechanical adjustment device resides in the provision of an iris diaphragm or a diaphragm ring, in other words, a rotatable disk having different size holes which can be located either between the central diaphragm 18 and the radiation source 1 or between the central diaphragm 18 and the radiation receiver 16.

A further possibility of accomplishing the mechanical adjustment or setting resides in providing a variable covering of the reference cell 12. By covering the reference cell 12 there is reduced the amount of the received light or radiation from the radiation source 1. Consequently, such is controlled so as to possess a more intensified transmitting output, so that there is increased the radiation scattered at the smoke or the like and which is received by the radiation receiver 16. The smoke detector thus becomes more sensitive. This can be accomplished, for instance, by changing the cross-section of the opening 8 in the diaphragm 3. This change also can be achieved by placing inserts 22 into the opening 8 which alter the cross-section of such opening 8 or by means of a rotatable ring member 23 which can be rotated about the lengthwise axis of the smoke detector, this ring member 23 containing openings or holes 8' of different cross-sectional areas. Finally, the opening 8 can be defined by a boundary portion 25 such that a displacement of the diaphragm 3 simultaneously causes a change in the cross-sectional area of the radiation beam which arrives by means of the opening 8 at the reference cell 12.

While there are shown and described present preferred embodiments of the invention, it is to be distinctly understood that the invention is not limited thereto, but may be otherwise variously embodied and practiced within the scope of the following claims.

Accordingly, what we claim is:

1. A smoke detector comprising:

a radiation source for emitting radiation in a predetermined radiation region;

a radiation receiver arranged externally of a direct radiation region of the radiation source;

said radiation receiver being impinged by radiation scattered by smoke particles located in the direct radiation region and delivering an output signal;

externally mechanically actuatable optical means for altering an output signal of the radiation receiver in a predetermined manner;

said optical means comprising a diaphragm displaceable along a predetermined direction of radiation for constricting an active solid angle viewed by the radiation receiver;

means for displacing said diaphragm;

said displacing means comprising cam means including a cam groove and detent means engaging with such cam groove;

said detent means being operatively connected with said displaceable diaphragm; and said displacing means accomplishing a defined displacement of said diaphragm upon rotation of said cam means.

2. The smoke detector as defined in claim 1, wherein:

said cam groove comprises a substantially helical-shaped cam groove.

3. The smoke detector as defined in claim 1, wherein:

said cam means includes a cam disk containing said cam groove.

4. The smoke detector as defined in claim 3, wherein:

said cam groove of said cam disk contains at least two substantially horizontally extending portions effectuating a defined adjustment of the diaphragm.

5. The smoke detector as defined in claim 4, further including:

a cover member; and said cover member contains at least one elongate hole by means of which it is possible to actuate said cam disk.

6. A smoke detector comprising:

a radiation source for emitting radiation in a predetermined radiation region;

a radiation receiver arranged externally of a direct radiation region of the radiation source;

said radiation receiver being impinged by radiation scattered by smoke particles located in the direct radiation region and delivering an output signal;

externally mechanically actuatable optical means for altering an output signal of the radiation receiver in a predetermined manner;

a reference cell positioned to receive radiation directly from the radiation source; and means for mechanically altering the amount of radiation received by the reference cell from the radiation source.

7. The smoke detector as defined in claim 6, wherein:

said externally mechanically actuatable optical means for altering the output signal of the radiation receiver in a predetermined manner contains an opening of a predetermined cross-section for directly passing radiation from said radiation source to said reference cell; and said means for mechanically altering the amount of radiation received by the reference cell from the radiation source constituting means for changing the cross-section of said opening for directly passing radiation from said radiation source to said reference cell.

8. The smoke detector as defined in claim 7, further including:

an insert of a preselectable size and placed in said opening in order to block a preselectable portion of the predetermined cross-section of said opening; and said insert constituting said means for changing the cross-section of said opening for directly passing radiation from said radiation source to said reference cell.

9. The smoke detector as defined in claim 7, further including:

an intermediate member comprising a predetermined number of holes of different cross-sectional areas and arranged intermediate said opening of said externally mechanically actuatable means and said reference cell;

said intermediate member being adjustable such that selectable ones of said holes of different cross-sectional areas are aligned to said opening for directly passing radiation from said radiation source to said reference cell; and said intermediate member constituting said means for changing the cross-section of said opening for directly passing the radiation from said radiation source to said reference cell.

10. The smoke detector as defined in claim 9, wherein:

said intermediate member constitutes a ring member and said holes of different cross-sectional areas are arranged along a predetermined circular line of said ring member;

a longitudinal axis defined by the smoke detector; and said ring member being rotatable about said longitudinal axis defined by the smoke detector in order to align selected ones of said holes in said ring member to said opening for directly passing radiation from said radiation source to said reference cell.

11. The smoke detector as defined in claim 6, wherein:

said externally mechanically actuatable optical means for alternating the output signal of the radiation receiver in a predetermined manner contains an opening of a predetermined cross-section for directly passing radiation from said radiation source to said reference cell;

said externally mechanically actuatable optical means further comprising a boundary portion defining said opening;

said radiation received by said reference cell directly from said radiation source forming a radiation beam of a predetermined cross-sectional area;

said boundary portion of said externally mechanically actuatable optical means constituting said means for mechanically alternating the amount of radiation received by the reference cell from the radiation source; and said boundary portion blocking preselectable parts of said predetermined cross-sectional area of said radiation beam directly received by said reference cell from said radiation source as said optical means are externally mechanically actuated in order to alter the output signal of the radiation receiver in said predetermined manner.

* * * * *